United States Patent [19]

Dunne et al.

[11] Patent Number: 4,610,204

[45] Date of Patent: Sep. 9, 1986

[54] METHOD AND APPARATUS FOR GENERATING A HIGH-SPEED METALLIC JET

[76] Inventors: Brian B. Dunne, 7241 Rue Michael, LaJolla, Calif. 92037; John M. Walsh, 1599 Camino Medio, Los Alamos, N. Mex. 87544

[21] Appl. No.: 624,214

[22] Filed: Jun. 25, 1984

[51] Int. Cl.[4] ..... F42B 11/26

[52] U.S. Cl. ..... 102/476; 102/306

[58] Field of Search ..... 102/306–310, 102/430, 439, 475, 501, 476, 520–523, 532

[56] References Cited

U.S. PATENT DOCUMENTS

| | | | |
|---|---|---|---|
| 1,416,828 | 5/1922 | Holmes | 102/430 X |
| 3,119,178 | 1/1964 | Owen et al. | 102/306 X |
| 3,233,688 | 2/1966 | Bell | 102/307 X |
| 3,267,853 | 8/1966 | Merendino et al. | 102/306 |
| 3,695,141 | 10/1972 | Kronman et al. | 102/501 |
| 3,913,488 | 10/1975 | Dunetz et al. | 102/501 |

*Primary Examiner*—Harold J. Tudor
*Attorney, Agent, or Firm*—Welsh & Katz, Ltd.

[57] ABSTRACT

A high-speed penetrating metallic jet is produced using a projectile accelerated by a compressed gas or chemical propellant charge as the source of momentum and energy. The propellant charge and projectile are positioned within a tubular bore such as a gun barrel upstream from a discharge end. A metallic disc is releasably maintained in transverse relation within the bore between the projectile and discharge end. The projectile has a concave contoured impact plate of high density operative to strike the metallic disc upon ignition of the propellant so as to accelerate the disc outwardly from the discharge end while simultaneously causing the disc to collapse radially inwardly toward the barrel axis and create an elongated metallic jet. The invention finds particular application in the penetration of geological strata, concrete, steel, water and many other materials used in fabrication and construction whenever penetrations or perforations are desired.

19 Claims, 7 Drawing Figures

METHOD AND APPARATUS FOR GENERATING A HIGH-SPEED METALLIC JET

BACKGROUND OF THE INVENTION

The present invention relates generally to high-speed penetrating metallic jets, and more particularly to a novel method and apparatus for generating a high-speed penetrating metallic jet which eliminates the use of high explosives as have heretofore been employed.

For several decades metal-lined high explosive charges, commonly termed shaped charges, have been employed to generate penetrating metallic jets. In a typical shaped-charge design, a cylindrical charge of high explosive is detonated to rapidly collapse a thin metal liner, often copper, upon the axis of symmetry. Because the detonation pressures produced are much higher than the yield strength of the liner, the metallic liner deforms almost as if it were fluid, then elongates, because of its geometry, into a high speed jet and a lower speed slug. Such jets are extremely penetrating.

Examples of recent shaped-charge designs are disclosed in U.S. Pat. Nos. 2,595,960 (Lawrence), 2,628,559 (Jasse), 2,809,585 (Moses), 3,443,518 (Cross), 3,675,575 (Bailey, et al.), 3,695,141 (Kronman, et al.), 3,948,181 (Bergstrom) and 4,004,515 (Mallory, et al.).

The known shaped-charge devices have the disadvantage that they create a danger to operating personnel, may effect shock damage, are noisy and create a fire hazard, and generally require special storage and handling procedures, as well as being relatively expensive.

SUMMARY OF THE INVENTION

A general object of the present invention is to provide a novel method and apparatus for generating a high-speed penetrating metallic jet.

A more particular object of the present invention is to provide a novel method and apparatus for generating a high-velocity penetrating metallic jet wherein a chemical propellant is utilized as a source of momentum for a projectile disposed within a gun bore and having a high density concave impact plate which is caused to impact a metallic disc disposed within the bore substantially perpendicular to the axis of movement of the impact plate such that the disc is accelerated toward the muzzle end of the bore and simultaneously caused to collapse into a high-velocity elongated symmetrical jet.

In accordance with the invention, a projectile having a contoured concave impact face is mounted on a lightweight sabot structure and accelerated toward the muzzle or discharge end of the bore of a gun barrel. The face of the projectile is caused to impact a metallic disc supported generally perpendicular to the muzzle or discharge end of the gun bore such that the metallic disc is simultaneously accelerated in the direction of projectile motion and caused to collapse in symmetrical fashion toward the gun barrel axis. The relative magnitudes of the forward velocity and the field of the collapse velocities of particles in the original disc can be accurately controlled by proper contouring of the front impact face of the projectile.

The collapse of the metallic disc toward the axis of the bore causes the material of the disc to predictably deform and subsequently elongate into a metallic jet. The jet produced has a gradient in velocity such that velocities at any given time increase with distance traveled along the gun bore axis. The metallic jet thus stretches as it propagates. It elongates many projectile diameters before finally breaking into particles, or undergoing wavy instability.

When the elongated jet impacts with solid and/or liquid materials, the impact pressure produced is proportional to the density of the jet multiplied by the jet velocity squared. With projectile velocities readily attainable with conventional gun technology, the impact pressure can be at least 20 times the yield stress of the target. Typical concave projectiles can be constructed of copper and upon impact with a copper target disc, can produce a copper jet. The jet thus produced can be expected to penetrate about the jet length into a copper target. Greater penetrations would occur in less dense media, and have been found to be in proportion to the reciprocal of the square root of the target density. Thus, a copper jet penetrating a target material having a density one-fourth that of copper could be expected to penetrate twice the jet length.

In accordance with the invention, any type of conventional gun configuration for firing a high velocity projectile can be employed. The concave impact plate projectile is preferably attached to a lightweight sabot member operative to maintain the impact plate coaxial with the axis of the barrel bore, seal against blowby gases from the propellant and reduce the projectile-barrel friction. The sabot member is of a tough, strong, yet lightweight material and, when attached to the concave impact plate, serves to minimize projectile mass and hence increase effective projectile velocity. The concave impact plate should be of a thickness approximating that of the metallic disc, and it is desirable for the impact plate to be made of a high density material. Preferably, a low density stopping material is provided in the bore between the metallic disc and the muzzle or discharge end of the bore so that the metallic jet will readily pass through the stopping material while the impact plate projectile will be decelerated so as to enable reuse with another disc.

Further objects, features and design aspects of the invention will become apparent from the following description of the invention when taken in conjunction with the accompanying drawings wherein like reference numerals represent like elements throughout the several views.

DESCRIPTION OF PREFERRED EMBODIMENT

Figure 1:
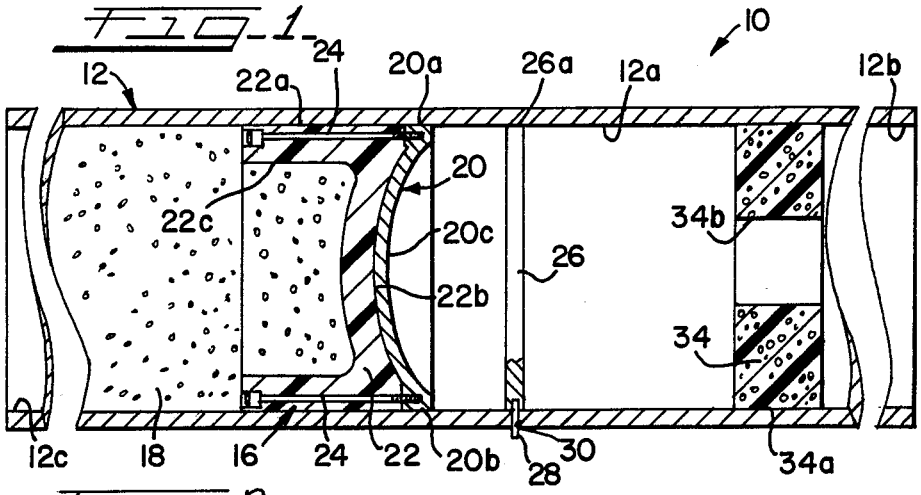
FIG. 1 is a fragmentary longitudinal sectional view of a gun barrel illustrating the present invention with a concave impact plate projectile and associated sabot member shortly before impact with a metallic disc.
Figure 2:
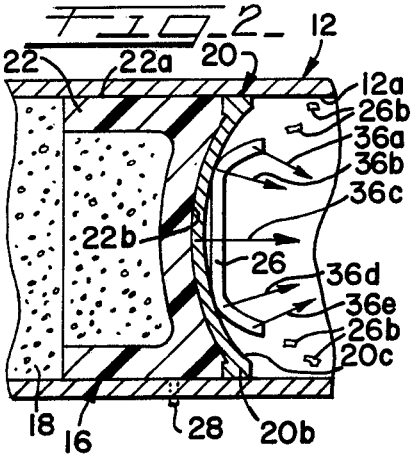
FIG. 2 is a fragmentary longitudinal sectional view similar to FIG. 1 but illustrating the interaction between the concave impact projectile and the metallic disc after approximately one-half of the metal disc has been impacted.

Referring now to the drawing, and in particular to FIGS. 1 and 2, an apparatus for generating a high-speed penetrating metallic jet in accordance with the present invention is indicated generally at 10. The apparatus 10 includes an elongated tubular barrel 12 having a cylindrical longitudinal bore 12*a* which opens outwardly on at least one end of the barrel, such as a distal or muzzle end 12*b* which defines a discharge end of the bore. The end of the barrel opposite the discharge end 12*b* defines a proximal end of the barrel which, for purposes of illustration, is indicated at 12*c* in FIG. 1. The barrel 12 may comprise a gun barrel with the proximal end 12*c* having operative association with means (not shown) for supporting the barrel and facilitating the introduction of a chemical propellant as will be described.

In accordance with the invention, projectile means in the form of a projectile, indicated generally at 16, is adapted to be inserted within the bore 12*a* so as to be freely accelerated along the bore by propellant gases, such as indicated at 18, created by ignition of the chemical propellant adjacent the proximal end 12*c* of the barrel. The projectile 16 includes a metallic impact plate 20 having an outer peripheral generally cyclindrical surface 20*a* adapted for low friction relation within the cylindrical bore 12*a* such that the impact plate lies generally transverse to the longitudinal axis of the bore. The outer peripheral edge of the impact plate 20 may have a slightly enlarged annular rim 20*b* formed thereon, the outer surface of which defines the cylindrical peripheral surface 20*a*. The impact plate has a concave contoured impact surface 20*c* symmetrical about the center axis of the impact plate which substantially coincides with longitudinal axis of the bore 12*a*. The impact plate is preferably of uniform thickness except for the annular rim portion 20*b*.

The projectile 16 also includes a sabot member 22 having an outer cylindrical surface 22*a* in sliding contact with the bore 12*a* so as to enable the sabot member to readily move along the bore. The sabot member 22 is preferably made of a lightweight material, such as a suitable plastic or low density metal, and has a concave forward surface 22*b* to which the concave impact plate 20 is affixed in substantially full surface contact therewith. The impact plate 20 is preferably secured to the concave surface 22*b* of the sabot member as by bolts shown at 24 in FIG. 1, or by suitable adhesive, or by welding. In the illustrated embodiment, the sabot member 22 has a recess 22*c* formed therein for purposes of reducing the mass of the sabot member. The lightweight sabot member also serves to maintain the impact plate 20 centrally and transverse to the bore 12*a* so as to minimize friction between the impact plate and the barrel bore surface.

As will be described, it may be desired to provide for reuse of both the sabot member 22 and the metallic impact plate 20 after being discharged from the discharge end 12*b* of the barrel 12. In an alternative embodiment, the metallic impact plate 20 and associated sabot member 22 may be made of an expendable material which is not intended to be retrieved or recovered for reuse after discharge from the barrel 12. When it is desired to make the impact plate 16 expendable, it might be made of lead or other similar material. When it is desired to provide for reuse of the impact plate 20, it is preferably made of hardened steel which provides good wear characteristics and may be readily machined or shaped for attachment to the associated sabot member 22. Alternatively, the impact plate 20 could be made of a high density material such as depleted uranium, or a tantalum-tungsten alloy.

In accordance with the invention, the apparatus 10 is operative to create a high-speed penetrating metallic jet from a metallic disc 26 which is adapted to be positioned within the bore 12*a* of barrel 12 so as to lie in a plane substantially transverse to the longitudinal axis of the bore. In the embodiment illustrated in FIG. 1, the metallic disc 26 is generally planar and of substantially uniform thickness. The disc has a circular outer peripheral surface 26*a* sized to conform substantially to the barrel bore surface 12*a* so as to establish engagement with the bore surface about the full periphery of the disc. The disc 26 is coaxial with and symmetrical about the longitudinal axis of bore 12*a* and is positioned within the bore in spaced relation from the discharge or muzzle end 12*b*.

The disc is releasably maintained in transverse relation to bore 12*a* by support means in the form of three locating pins, one of which is shown at 28 in FIG. 1, which are spaced equidistantly about the circumference of barrel 12 and are received within suitable coplanar radial openings, such indicated at 30, formed in the barrel wall. The inner ends of the locating pins are received within suitable radial recesses or bores in the outer peripheral surface 26*a* of disc 26. The radial locating pins 28 comprise shear pins which are adapted to shear at the interface of the outer surface 26*a* of disc 26 with the barrel bore surface 12*a* when the disc is impacted by the impact plate 20 at a predetermined force acting generally in a direction toward the discharge or muzzle end 12*b* of the barrel. After impact, the disc 26 is transformed into what may be referred to hereinafter as a "jet" or the impact formed jet. The shear pins 28 may be of a length sufficient to extend outwardly from the outer surface of the barrel to facilitate removal of the pin stubs remaining after shearing.

Figure 7:
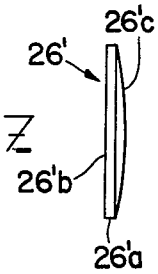
FIG. 7 illustrates an alternative metallic disc, on a reduced scale, of lenticular configuration which may be employed with the concave impact plate projectile and associated sabot member as illustrated in FIG. 1.

FIG. 7 illustrates an alternative embodiment of a metallic disc, indicated at 26′, which may be employed in the apparatus 10 to create a high-speed penetrating metallic jet. The disc 26′ has a circular outer peripheral surface 26′*a* sized to conform to the barrel bore surface 12*a* in similar fashion to disc 26, and is configured in a lenticular shape so as to be made generally more effective in generation of a jet upon impact by the impact plate 20. The lenticular disc 26′ is illustrated as having one generally planar surface 26′*b* which would face the impact plate 20, and an opposite slightly convex surface 26′*c* thus being plano-convex. It will be understood that the lenticular disc 26′ may alternatively have biconvex, converging meniscus, plano-concave, biconcave or diverging meniscus opposite surface configurations.

In the operation of the apparatus 10, the projectile 16 including the impact plate 20 and associated sabot member 22 are inserted into the barrel bore 12*a* either from the proximal end 12*c* or, if inserted prior to insertion of disc 26, from the muzzle end 12*b* of the barrel. A suitable propellant charge consisting of compressed gas, such as air, or a chemical propellant such as smokeless powder, is positioned in the barrel on the upstream side of the sabot member 22. The disc 26 or 26' is inserted into the barrel bore 12*a* and releasably retained transverse to the axis of the bore through shear pins such as shown at 28.

Preferably, decelerating means in the form of a stopping material is inserted into the barrel bore 12*a* generally adjacent the muzzle end 12*b* so as to effect deceleration of the projectile 16 while enabling the impact formed jet 26 to readily pass therethrough as it is formed upon impact by the impact plate 20. The decelerating means may comprise an annular stopping member 34 formed of a relatively low density material such as small foam formed plastic pellets forming the annular member 34. The stopping member 34 has an outer peripheral surface 34*a* which frictionally engages the inner surface of bore 12*a*, and has an axial bore 34*b* of a size to enable the jet 26 to pass therethrough after being formed by impact plate 20. Alternatively, the decelerating means may comprise a circular stopping member having a low density enabling the jet 26 to readily pass therethrough as it is accelerated and formed into a metallic jet responsive to impact by plate 20. Whether formed as an annular or circular stopping member 34, the stopping member enables the metallic jet formed from disc 26 to pass therethrough while causing the impact plate 20 and associated sabot member 22 to decelerate so as to facilitate their recovery for reuse.

Upon initiating reaction of the chemical propellant charge upstream of the projectile 16, the expanding propellant gases 18 act against the sabot member 22 and associated impact plate 20 and cause the impact plate to be accelerated longitudinally along the bore 12*a* sufficiently to impact the disc 26 with a predetermined impact force so as to easily shear the locating pins 28 and effect release of the disc. After impact by the impact plate 20, the disc 26 collapses toward the axis of bore 12*a* during which it deforms and progressively elongates into a metallic penetrating jet. FIG. 2 illustrates the interaction between the concave impact plate 20 and the metallic disc 26 at a stage at which approximately one-half of the metallic disc has been impacted by the impact disc. As shown by the velocity vectors represented at 36*a–e* in FIG. 2, the metallic disc 26 is caused to undergo a combination of forward motion and collapse toward the axis of the bore 12*a*. Upon impact of the disc 26 by the impact plate 20, minute pieces of the outer rim or periphery of the disc may break off, such as indicated at 26*b* in FIG. 2, and be lost.

Figure 3:
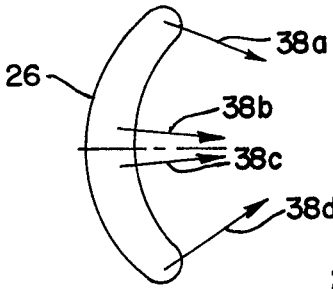
FIG. 3 illustrates, on an enlarged scale, the metallic disc as it appears within the gun barrel after impact but before jet-formation, the velocity vectors being represented by vector arrows.
Figure 4:
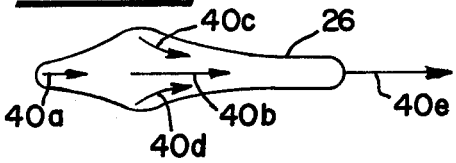
FIG. 4 illustrates the metallic disc still within the gun barrel but at complete collapse, following which the velocity field eventually produces an elongated metallic jet.
Figure 5:
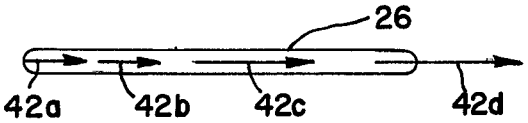
FIG. 5 illustrates an early stage of the elongating metallic jet in flight.
Figure 6:
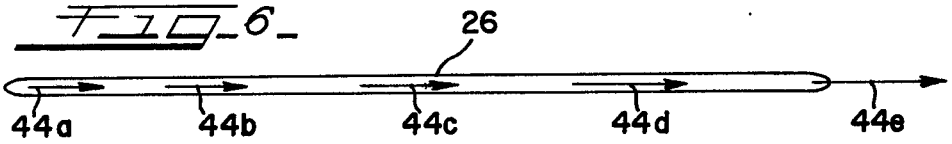
FIG. 6 illustrates a later stage of the metallic jet in flight during which the velocity gradient causes the jet to continually stretch as it propagates down the gun barrel axis, and exits from the muzzle end.

FIGS. 3–6 illustrate the jet 26 on an enlarged scale and during more advanced stages of collapse into an elongated metallic jet as shown in FIG. 6. For example, FIG. 3 illustrates the jet 26 after being fully impacted by plate 16 but before the jet is fully collapsed into an elongated metallic jet. In the condition shown in FIG. 3, the jet 26 is undergoing deformation as represented by the velocity vectors 38*a–d*. FIG. 4 shows the condition of the collapsing metallic jet 26 at a position wherein it still remains within the bore 12*a* and has undergone further collapse. In the condition shown in FIG. 4, the velocity vectors, indicated at 40*a–c*, are acting substantially in the direction of the axis of bore 12*a* and the jet begins a more pronounced longitudinal elongation.

FIG. 5 illustrates the metallic jet 26 during its early stages of elongation while still within barrel 12 at which time the velocity vectors, indicated at 42*a–d*, are acting generally parallel to the longitudinal axis of the elongated jet and produce a velocity gradient wherein the velocity vectors decrease in magnitude from the forwardmost vector 42*d* to the rearwardmost vector 42*a*, thus demonstrating the continued elongation of the jet. At this point, the jet is substantially symmetrical about its longitudinal axis.

FIG. 6 illustrates a later stage of elongation of the metallic jet during flight after discharge from the bore 12*a* in which the increasing velocity vectors of the jet mass elements, indicated at 44*a–e*, continue to subject the jet to a velocity gradient which causes the jet to continue to stretch or elongate as a function of time as it traverses a path substantially coincident with the gun barrel axis. The metallic jet formed from disc 26 or 26' thus stretches longitudinally as it moves along the gun barrel axis such that it elongates many projectile diameters before breaking into particles or undergoing wavy instability. When the elongated jet impacts with a solid and/or liquid target surface, the impact pressure produced is proportional to the density of the jet multiplied by the jet velocity squared. With projectile velocities readily obtainable with conventional gun technology, the impact pressure can be as great as 20 times the yield stress of the target material.

In some applications maximizing the depth of target penetration is desirable, while, in others, optimizing target hole diameter is required. In maximizing target penetration, the length of the metallic jet is the important parameter, providing jet velocity is greater than a threshold velocity needed to overcome target strength. Target hole diameter is primarily a function of jet velocity and increases approximately as the square of the jet velocity.

The design factors which are believed most important for maximizing the various quantities are as follows: to maximize jet length, and hence target penetration, the ductility of the jet material is of prime importance. This requires consideration of the ductile elongation that occurs at the strain-rates and material states that occur in jet elongation. Copper has proved to be very ductile in the high stress rates obtained in ordinary shaped charge applications, and may be employed for the discs 26 and 26' of the present invention. For lower-velocity applications, lower-melting temperature elements such as lead, tin, zinc, or cadmium may be used. The discs 26 and 26' can also be made from porous metals such as compacted powders. Various alloys of these metals can also be used. An important consideration affecting material choice for the discs 26 and 26' is that the jet be of low tensile strength, to delay particulation, but not become completely liquid upon deformation. Thus, a number of pure metals and alloys can be employed for discs 26 and 26', and the optimum choice of disc material will depend on a particular application.

To maximize target hole diameter, a jet of maximum kinetic energy per unit length is required. Jet velocity is thus important and can be affected by the velocity of the projectile impact plate 20 (roughly proportional) and the shock impedance (or the product of density and sound velocity) of the impact plate. The latter should be a high density incompressible material such as steel, depleted uranium or a tungsten tantalum alloy, although copper or lead may also be employed, the latter materials being appropriate in many applications because of economic considerations. The discs 26 and 26' may also be cast or made by powder metallurgical techniques which provide dense and relatively inexpensive metallic discs.

The velocity of the projectile impact plate 20 can be controlled over a wide range (up to several km/sec) by straightforward application of known gun and propellant technology. Thus, gun barrel length, type and quantity of propellant powder, and projectile plate mass may be varied to vary the velocity imparted to the impact plate 20. It follows that the projectile sabot member 22 and associated impact plate 20 must be strong enough to withstand the desired acceleration within the barrel bore.

The contour design of the projectile impact plate 20 may vary depending on the intended application for apparatus 10. For example, relatively flat contours (large radii of curvature) cause relatively small convergence velocities for the metallic disc 26, while leaving the average forward velocity of the disc essentially unchanged. In this case the jet formation process occurs relatively slowly, causing the jet elongation at a given target distance to be relatively small. Decreasing the radius of curvature of the concave impact plate increases the rate of collapse of the metal discs 26 and 26' while leaving the forward velocity of the disc essentially unchanged. The net effect is to increase the velocity gradient within the jet, and to increase the associated jet elongation for a given distance to the target surface. Thus, for applications where the muzzle end of the barrel is relatively close to the target surface, such as in the order of 5–20 times the diameter of the impact plate 20, the radius of curvature of the concave surface of impact plate 20 should be nearly the same length as the diameter of the impact plate. Impact plates having flatter concave impact surfaces are useful for applications with larger target standoff distances.

The aforedescribed apparatus 10 may be sized for a particular application. Substantially all of the physical processes in the jet-generation flow are believed to be subject to simple scaling. For example, if the apparatus 10 is optimally sized for use with one projectile diameter, i.e. 1 cm, a similar apparatus can be scaled to another projectile diameter, i.e. 15 cm, by multiplying the dimensions of the projectile length, thickness of projectile concave impact plate 20, diameter and thickness of metallic disc 26, and length and diameter of the barrel 12, etc., by the same factor, e.g. 15 in this example. The resulting design will be near optimum; jet velocities at corresponding points in the jet will be the same; times will be increased by the scale factor; and jet masses will increase by a factor which is the cube of the scale factor. Target penetration distances and penetration hole diameters will also scale, under simple scaling, by the scale factor.

While a preferred method and apparatus for creating a high-velocity penetrating mass have been illustrated and described, it will be understood by those skilled in the art that changes and modifications may be made therein without departing from the invention in its broader aspects. Various features of the invention are defined in the following claims.

What is claimed is:

1. Apparatus for creating a high-speed metallic jet comprising; means defining an elongated barrel having a longitudinal bore opening outwardly of at least one end of said barrel so as to establish a discharge end, a metallic disc of a size enabling said disc to be positioned within said bore so as to lie in a plane substantially perpendiuclar to the longitudinal axis of said bore, means cooperative with said disc and said barrel for releasably supporting said disc within said bore in transverse relation thereto, said support means enabling movement of said disc along said bore when subjected to a predetermined force acting in a direction substantially toward said discharge end, a propellant charge disposed on the upstream side of said disc, and projectile means including an impact plate interposed between said disc and said propellant charge, said impact plate having a concave impact surface facing said disc, said propellant charge and said projectile means being operative in response to actuation of said propellant charge to cause said impact plate to impact said disc with sufficient momentum to create an impact jet and accelerate said jet outwardly of said discharge end while simultaneously causing said jet to collapse into a configuration producing a high velocity elongated metallic jet.

2. Apparatus as defined in claim 1 wherein said means for supporting said disc within said bore includes means cooperable with an outer peripheral edge of said disc so as to release said disc for movement along said bore when said disc is subjected to said predetermined force.

3. Apparatus as defined in claim 2 wherein said disc supporting means includes generally radial shear pins operative to shear and thereby release said disc when subjected to said predetermined force.

4. Apparatus as defined in claim 3 wherein said shear pins position said disc such that the resulting jet moves substantially along the longitudinal axis of said barrel.

5. Apparatus as defined in claim 1 including a low density stopping material disposed within said barrel downstream of said disc to effect deceleration of said projectile means so as to facilitate recovery thereof after discharge from said barrel.

6. Apparatus as defined in claim 1 wherein said disc is of substantially uniform thickness and is responsive to impact by said concave surface of said impact plate to effect collapse of said disc in a manner to cause the resulting metallic jet to elongate during flight whereby to maximize penetration into a target surface spaced from said discharge end.

7. Apparatus as defined in claim 1 wherein said disc is configured in a lenticular shape so as to be made generally more effective in generation of a jet upon impact by said impact plate.

8. Apparatus as defined in claim 1 wherein said disc is spaced from said discharge end of said barrel.

9. Apparatus as defined in claim 5 wherein said stopping material is in the form of an annular low density stopping member made of a foamed material and disposed coaxial with said disc, said annular stopping member be operative to enable substantially unobstructed passage of said impact formed jet therethrough.

10. Apparatus as defined in claim 1 wherein said projectile means includes a sabot member disposed between said impact plate and said propellant charge and being operative to maintain said impact plate in substantially transverse relation to said bore.

11. Apparatus as defined in claim 10 wherein said impact plate is mounted, on said sabot member, said sabot member being operative to substantially prevent blowby of propellant gases upon activation of said propellant charge.

12. Apparatus as defined in claim 1 wherein said impact plate is made of a high density incompressible metallic material.

13. Apparatus as defined in claim 12 wherein said impact plate is made from a material selected from the group consisting of steel, tungsten, tantalum, depleted uranium, copper and lead.

14. Apparatus as defined in claim 1 wherein said disc is made of a high density metallic material of relatively low tensile strength.

15. A method of creating a high-velocity metallic jet comprising the steps of:

(a) supporting a metallic disc within a gun bore havign a longitudinal axis such that said disc lies substantially perpendicular to said axis, and (b) impacting said disc with a concave impact surface propelled by a propellant charge such that said disc is impacted with sufficient velocity to effect acceleration of said disc along the axis of said bore while simultaneously collapsing said disc to produce a high-velocity elongated metallic jet.

16. The method as defined in claim 15 wherein said bore has a discharge end, said step of supporting said disc within said bore including interconnecting said disc to said barrel by means enabling release of said disc when subjected to said impacting by said concave impact surface.

17. The method as defined in claim 16 wherein said concave impact surface is formed on an impact plate opeative to accelerate along said bore, and including the steps of introducing a propellant charge into said bore upstream from said impact plate, and activating said propellant charge in a manner to accelerate said impact plate and thus effect impact of said concave impact surface with said disc.

18. The method as defined in claim 15 wherein said metallic disc is selected from the group consisting of a generally planar disc having substantially uniform thickness and a disc configured in a lenticular shape.

19. Apparatus as defined in claim 1 wherein said metallic disc is generally planar.

* * * * *